United States Patent [19]

Lewis

[11] 4,032,430

[45] June 28, 1977

[54] PROCESS FOR PRODUCING CARBON FIBERS FROM MESOPHASE PITCH

[75] Inventor: Irwin Charles Lewis, Lakewood, Ohio

[73] Assignee: Union Carbide Corporation, New York, N.Y.

[22] Filed: Dec. 11, 1973

[21] Appl. No.: 423,717

[52] U.S. Cl. ..... 208/39; 208/42; 264/29 R; 264/DIG. 19; 423/447.1

[51] Int. Cl.[2] ..... C10C 1/00

[58] Field of Search ..... 423/447; 264/29, DIG 19; 260/873, 898; 208/45, 44, 43, 39, 41, 42

[56] References Cited

UNITED STATES PATENTS

| | | | |
|---|---|---|---|
| 3,035,308 | 5/1962 | Ragoss et al. | 208/45 |
| 3,040,005 | 6/1962 | Bernhardt et al. | 264/176 Z |
| 3,355,377 | 11/1967 | King | 208/41 |
| 3,490,586 | 1/1970 | Jaisle | 208/44 |
| 3,552,922 | 1/1971 | Ishikawa et al. | 264/29 |
| 3,558,276 | 1/1971 | Otani | 423/447 |
| 3,595,946 | 7/1971 | Joo et al. | 264/29 |
| 3,634,220 | 1/1972 | Goan | 264/29 |
| 3,718,493 | 2/1973 | Joo et al. | 264/29 |
| 3,761,387 | 9/1973 | Wegener et al. | 208/45 |
| 3,767,741 | 10/1973 | Toyoguchi et al. | 264/29 |
| 3,787,541 | 1/1974 | Grindstaff et al. | 264/29 |
| 3,799,865 | 3/1974 | Suetsugu et al. | 208/131 |
| 3,814,566 | 6/1974 | Stroup | 264/29 |
| 3,919,376 | 11/1975 | Schulz | 264/102 |

*Primary Examiner*—Jay H. Woo
*Attorney, Agent, or Firm*—John S. Piscitello

[57] ABSTRACT

An improved process for producing pitch which has been transformed, in part, to a liquid crystal or so-called "mesophase" state. According to the process, pitch of a given mesophase content, suitable for producing carbon fibers, is produced in substantially shorter periods of time than heretofore possible, at a given temperature, by subjecting the pitch to reduced pressure during formation of the mesophase.

3 Claims, No Drawings

PROCESS FOR PRODUCING CARBON FIBERS FROM MESOPHASE PITCH

BACKGROUND OF THE INVENTION

1. Field of the Invention

This invention relates to an improved process for producing carbon fibers from pitch which has been tranformed, in part, to a liquid crystal or so-called "mesophase" state. More particularly, this invention relates to an improved process for producing carbon fibers from pitch of this type wherein the mesophase content is produced in substantially shorter periods of time than heretofore possible, at a given temperature, by subjecting the pitch to reduced pressure during formation of the mesophase.

2. Description of the Prior Art

As a result of the rapidly expanding growth of the aircraft, space and missile industries in recent years, a need was created for materials exhibiting a unique and extroaordinary combination of physical properties. Thus, materials characterized by high strength and stiffness, and at the same time of light weight, were required for use in such applications as the fabrication of aircraft structures, re-entry vehicles, and space vehicles, as well as in the preparation of marine deep-submergence pressure vessels and like structures. Existing technology was incapable of supplying such materials and the search to satisfy this need centered about the fabrication of composite articles.

One of the most promising materials suggested for use in composite form was high strength, high modulus carbon textiles, which were introduced into the market place at the very time this rapid growth in the aircraft, space and missile industries was occurring. Such textiles have been incorporated in both plastic and metal matrices to produce composites having extraordinary high-strength- and high-modulus-to-weight ratios and other exceptional properties. However, the high cost of producing the high-strength, high-modulus carbon textiles employed in such composites has been a major deterrent to their widespread use, in spite of the remarkable properties exhibited by such composites.

One recently proposed method of providing high-modulus, high-strength carbon fibers at low cost is described in copending application Ser. No. 338,147, now U.S. Pat. No. 4,005,183 entitled "High Modulus, High Strength Carbon Fibers Produced From Mesophase Pitch." Such method comprises first spinning a carbonaceous fiber from a carbonaceous pitch which has been transformed, in part, to a liquid crystal or so-called "mesophase" state, then thermosetting the fiber so produced by heating the fiber in an oxygen-containing atmosphere for a time sufficient to render it infusible, and finally carbonizing the thermoset fiber by heating in an inert atmosphere to a temperature sufficiently elevated to remove hydrogen and other volatiles and produce a substantially all-carbon fiber. The carbon fibers produced in this manner have a highly oriented structure characterized by the presence of carbon crystallites preferentially aligned parallel to the fiber axis, and are graphitizable materials which when heated to graphitizing temperatures develop the three-dimensional order characteristic of polycrystalline graphite and graphitic-like properties associated therewith, such as high density and low electrical resistivity. At all stages of their development from the as-drawn condition to the graphitized state, the fibers are characterized by the presence of large oriented elongated graphitizable domains preferentially aligned parallel to the fiber axis.

When natural or synthetic pitches having an aromatic base are heated under quiescent conditions at a temperature of about 350°–500° C., either at constant temperature or with gradually increasing temperature, small insoluble liquid spheres begin to appear in the pitch and gradually increase in size as heating is continued. When examined by electron diffraction and polarized light techniques, these spheres are shown to consist of layers of oriented molecules aligned in the same direction. As these spheres continue to grow in size as heating is continued, they come in contact with one another and gradually coalesce with each other to produce larger masses of aligned layers. As coalescence continues, domains of aligned molecules much larger than those of the original spheres are formed. These domains come together to form a bulk mesophase wherein the transition from one oriented domain to another sometimes occurs smoothly and continuously through gradually curving lamellae and sometimes more sharply curving lamellae. The differences in orientation between the domains create a complex array of polarized light extinction contours in the bulk mesophase corresponding to various types of linear discontinuity in molecular alignment. The ultimate size of the oriented domains produced is dependent upon the viscosity, and the rate of increase of the viscosity, of the mesophase from which they are formed, which, in turn are dependent upon the particular pitch and the heating rate. In certain pitches, domains having sizes in excess of two hundred microns up to in excess of one thousand microns are produced. In other pitches, the viscosity of the mesophase is such that only limited coalescense and structural rearrangement of layers occur, so that the ultimate domain size does not exceed one hundred microns.

The highly oriented, optically anisotropic, insoluble material produced by treating pitches in this manner has been given the term "mesophase," and pitches containing such material are known as "mesophase pitches." Such pitches, when heated above their softening points, are mixtures of two essentially immiscible liquids, one the optically anisotropic, oriented mesophase portion, and the other the isotropic non-mesophase portion. The term "mesophase" is derived from the Greek "mesos" or "intermediate" and indicates the pseudo-crystalline nature of this highly-oriented, optically anisotropic material.

Carbonaceous pitches having a mesophase content of from about 40 percent by weight to about 90 percent by weight are suitable for spinning into fibers which can subsequently be converted by heat treatment into carbon fibers having a high Young's modulus of elasticity and high tensile strength. In order to obtain the desired fibers from such pitch, however, it is not only necessary that such amount of mesophase be present, but also that it form, under quiescent conditions, a homogeneous bulk mesophase having large coalesced domains, i.e., domains of aligned molecules in excess of 200 microns up to in excess of 1000 microns in size. Pitches which form stringy bulk mesophase under quiescent conditions, having small oriented domains, rather than large coalesced domains, are unsuitable. Such pitches form mesophase having a high viscosity which undergoes only limited coalescense, insufficient to produce large coalesced domains having sizes in excess of 200 microns. Instead, small oriented domains of mesophase agglomerate to produce clumps or stringy masses wherein the ultimate domain size does not exceed 100 microns. Certain pitches which polymerize very rapidly are of this type. Likewise, pitches which do not form a homogeneous bulk mesophase are unsuitable. The latter phenomenon is caused by the presence of infusible solids (which are either present in the original pitch or which develop on heating) which are enveloped by the coalescing mesophase and serve to interrupt the homogeneity and uniformity of the coalesced domains, and the boundaries between them.

Another requirement is that the pitch be nonthixotropic under the conditions employed in the spinning of the pitch into fibers, i.e., it must exhibit a Newtonian or plastic flow behavior so that the flow is uniform and well behaved. When such pitches are heated to a temperature where they exhibit a viscosity of from about 10 poises to about 200 poises, uniform fibers may be readily spun therefrom. Pitches, on the other hand, which do not exhibit Newtonian or plastic flow behavior at the temperature of spinning, do not permit uniform fibers to be spun therefrom which can be converted by further heat treatment into carbon fibers having a high Young's modulus of elasticity and high tensile strength.

Carbonaceous pitches having a mesophase content of from about 40 percent by weight to about 90 percent by weight can be produced in accordance with known techniques, as disclosed in aforementioned copending application Ser. No. 338,147, now U.S. Pat. No. 4,005,183 by heating a carbonaceous pitch in an inert atmosphere at a temperature above about 350° C. for a time sufficient to produce the desired quantity of mesophase. By an inert atmosphere is meant an atmosphere which does not react with the pitch under the heating conditions employed, such as nitrogen, argon, xenon, helium, and the like. The heating period required to produce the desired mesophase content varies with the particular pitch and temperature employed, with longer heating periods required at lower temperatures than at higher temperatures. At 350° C., the minimum temperature generally required to produce mesophase, at least one week of heating is usually necessary to produce a mesophase content of about 40 percent. At temperatures of from about 400° C. to 450° C., conversion to mesophase proceeds more rapidly, and a 50 percent mesophase content can usually be produced at such temperatures within about 1–40 hours. Such temperatures are generally employed for this reason. Temperatures above about 500° C. are undesirable, and heating at this temperature should not be employed for more than about 5 minutes to avoid conversion of the pitch to coke.

Although the time required to produce a mesophase pitch having a given mesophase content is reduced as the temperature of preparation rises, it has been found that heating at elevated temperatures adversely affects the rheological properties of the pitch by altering the molecular weight distribution of both the mesophase and non-mesophase portions of the pitch. Thus, heating at elevated temperatures tends to increase the amount of high molecular weight molecules in the mesophase portion of the pitch. At the same time, heating at such temperatures also results in an increased amount of low molecular weight molecules in the non-mesophase portion of the pitch. As a result, mesophase pitches of a given mesophase content prepared at elevated temperatures in relatively short periods of time have been found to have a higher average molecular weight in the mesophase portion of the pitch and a lower average molecular weight in the non-mesophase portion of the pitch, then mesophase pitches of like mesophase content prepared at more moderate temperatures over more extended periods. This wider molecular weight distribution has been found to have an adverse effect on the rheology and spinnability of the pitch, evidently because of a low degree of compatibility between the very high molecular weight fraction of the mesophase portion of the pitch and the very low molecular weight fraction of the non-mesophase portion of the pitch. The very high molecular weight material in the mesophase portion of the pitch can only be adequately plasticized at very high temperatures where the tendency of the very low molecular weight molecules in the non-mesophase portion of the pitch to volatilize is greatly increased. As a result, when such pitches are heated to a temperatures where they have a viscosity suitable for spinning and attempts are made to produce fibers therefrom, excessive expulsion of volatiles occurs which greatly interferes with the processability of the pitch into fibers of small and uniform diameter. For these reasons, means have been sought for shortening the time required to produce mesophase pitch at relatively moderate temperatures of preparation where more favorable rheological properties are imparted to the pitch.

SUMMARY OF THE INVENTION

In accordance with the present invention, it has now been discovered that mesophase pitch of a given mesophase content can be prepared in substantially shorter periods of time than heretofore possible, at a given temperature, if the pitch is subjected to reduced pressure during formation of the mesophase. Treating the pitch under reduced pressure in this manner aids in the removal of volatile low molecular weight components initially present, together with low molecular weight polymerization by-products of the pitch, and results in the more efficient conversion of the precursor pitch to mesophase pitch. Mesophase pitches having a mesophase content of from about 40 percent by weight to about 90 percent by weight can be prepared in this manner, at a given temperature, at a rate of up to more than twice as fast as that normally required in the absence of such treatment, i.e., in periods of time as little as less than one-half of that normally required when mesophase is produced in the absence of reduced pressure.

DESCRIPTION OF THE PREFERRED EMBODIMENTS

As a carbonaceous pitch is heated to a temperature sufficiently to produce mesophase, the more volatile low molecular weight molecules present therein are slowly volatilized from the pitch. As heating is continued above a temperature at which mesophase is produced, the more reactive higher molecular weight molecules polymerize to form still higher molecular weight molecules, which then orient themselves to form mesophase. While the less reactive lower molecular weight molecules which have not been volatilized can also polymerize, they often form hydrogenated and/or substituted polymerization by-products having a molecular weight below about 600 which do not orient to form mesophase. Although these low molecular weight polymerization by-products are gradually volatilized as heating of the pitch is continued, the presence of large amounts of these by-products during much of the time that the pitch is being converted to mesophase has been found to impede the formation of mesophase by the more reactive molecules, and, as a result, to considerably lengthen the time necessary to produce a pitch of a given mesophase content. Further, because of their small size and low aromaticity, these polymerization by-products are not readily compatible with the larger, higher molecular weight, more aromatic molecules present in the mesophase portion of the pitch, and the lack of compatibility between these high and low molecular weight molecules adversely affects the rheology and spinnability of the pitch. As pointed out previously, the very high molecular weight fraction of the mesophase portion of the pitch can only be adequately plasticized at very high temperatures where the tendency of the very low molecular weight molecules in the non-mesophase portion of the pitch to volatilize is greatly increased, and when pitches having large amounts of such materials are heated to a temperature where they have a viscosity suitable for spinning and attempts are made to produce fibers therefrom, excessive expulsion of volatiles occurs which greatly interferes with the processability of the pitch into fibers of small and uniform diameter.

This invention takes advantage of the differences in molecular weight and volatility between the mesophase-forming molecules present in the pitch and those low molecular weight components and polymerization by-products which do not form mesophase to effect removal of the undesirable more volatile low molecular weight materials and more rapidly convert the pitch to mesophase. The molecules which do not convert to mesophase are of lower molecular weight than the higher molecular weight mesophase-forming molecules and, facilitated by the vacuum present during conversion of the pitch to mesophase, are preferentially volatilized from the pitch during formation of the mesophase, allowing the pitch to obtain a given mesophase content in substantially reduced periods of time. Thus, in addition to shortening the time required to produce a pitch of a given mesophase content, this procedure has the effect of lessening the amount of low molecular weight molecules in the non-mesophase portion of the pitch and raising the average molecular weight thereof. Consequently, such pitches can more easily be spun into fibers of small and uniform diameter with little evolution of volatiles.

Removal of the more volatile components of the pitch which do not convert to mesophase is effected by subjecting the pitch to a pressure of less than about 100 millimeters Hg, preferably less than 30 millimeters Hg, during preparation of the mesophase. As aforementioned, removal of the undesirable more volatile low molecular weight materials hastens conversion of the pitch to mesophase, and when mesophase is produced under vacuum in this manner, the time required to produce a pitch of a given mesophase content, at a given temperature, is reduced by as much as more than one-half of that normally required in the absence of reduced pressure. Generally, the time required to produce a pitch of a given mesophase content is reduced by at least 25 percent, usually from 40 percent to 70 percent, when the mesophase is prepared under vacuum as described as opposed to when it is prepared under identical conditions but in the absence of reduced pressure.

While any temperature above about 350° C. up to about 500° C. can be employed to convert the precursor pitch to mesophase, it has been found that mesophase pitches possess improved rheological and spinning characteristics when they are prepared at a temperature of from 380° C. to 440° C., most preferably from 380° to 410° C., so as to produce a mesophase content of from 50 percent by weight to 65 percent by weight. Usually from 2 hours to 60 hours of heating are required at such temperatures to produce the desired amount of mesophase. Mesophase pitches prepared under these conditions have been found to possess a smaller differential between the number average molecular weights of the mesophase and non-mesophase portions of the pitch, than mesophase pitches having the same mesophase content which have been prepared at more elevated temperatures in shorter periods of time. The attendant rheological and spinning properties accompanying this narrower molecular weight distribution has been found to substantially facilitate the processability of the pitch into fibers of small and uniform diameter.

The mesophase pitches prepared under the preferred conditions, i.e., by heating at a temperature of from 380° to 440° C. so as to produce a mesophase content of from 50 percent by weight to 65 percent by weight possess a lesser amount of high molecular weight molecules in the mesophase portion of the pitch and a lesser amount of low molecular weight molecules in the non-mesophase portion of the pitch, and have a lower number average molecular weight in the mesophase portion of the pitch and a higher number average molecular weight in the non-mesophase portion of the pitch, than mesophase pitches having the same mesophase content which have been prepared at more elevated temperatures in shorter periods of time. When mesophase pitches are prepared under such conditions, less than 50 percent of the molecules in the mesophase portion of the pitch have a molecular weight in excess of 4000, while the remaining molecules have a number average molecular weight of from 1400 to 2800. The molecules in the non-mesophase portion of such pitches have a number average molecular weight of from 800 to 1200, with less than 20 percent of such molecules having a molecular weight of less than 600. When such pitches are prepared by heating at the most preferred temperatures range of from 380° to 410° C., from 20 percent to 40 percent of the molecules in the mesophase portion of the pitch have a molecular weight in excess of 4000, while the remaining molecules have a number average molecular weight of from 1400 to 2600. The molecules in the non-mesophase portion of pitches prepared by heating at the most preferred temperature range have a number average molecular weight of from 900 to 1200, with from 10 percent to 16 percent of such molecules having a molecular weight of less than 600. When mesophase pitches are prepared at temperatures in excess of 440° C., on the other hand, more than 80 percent of the molecules in the mesophase portion of the pitch have a molecular weight in excess of 4000, while in excess of 25 percent of the molecules in the non-mesophase portion of the pitch have a molecular weight of less than 600. The molecules in the non-mesophase portion of the pitch have a number average molecular weight of less than 800, while the number average molecular weight of the molecules in the mesophase portion of the pitch which do not have a molecular weight in excess of 4000 is from 1400 to 2800.

Mesophase pitches prepared by heating at a temperature of from 380° to 440° C. so as to produce a mesophase content of from 50 percent by weight to 65 percent by weight usually exhibit a viscosity of from 10 poises to 200 poises at a temperature of from 320° to 440° C., and can readily be spun into fibers of small and uniform diameter at such temperatures with little evolution of volatiles. Because of their excellent rheological properties, such pitches are eminently suitable for spinning carbonaceous fibers which may subsequently be converted by heat treatment into fibers having a high Young's modulus of elasticity and high tensile strength.

In order to produce pitches having the preferred mesophase content and molecular weight characteristics, it is usually necessary to heat a carbonaceous pitch at a temperature of from 380° to 440° C. for at least 2 hours, preferably for from 2 hours to 60 hours. Excessive heating should be avoided so as not to produce a mesophase content in excess of 65 percent by weight, or adversely affect the desired molecular weight distribution. To obtain the desired molecular weight characteristics it is also necessary that the pitch be agitated during formation of the mesophase so as to produce a homogeneous emulsion of the immiscible mesophase and non-mesophase portions of the pitch. Such agitation can be effected by any conventional means, e.g., by stirring or rotation of the pitch, so long as it is sufficient to effectively intermix the mesophase and non-mesophase portions of the pitch.

The degree to which the pitch has been converted to mesophase can readily be determined by polarized light microscopy and solubility examinations. Except for certain non-mesophase insolubles present in the original pitch or which, in some instances, develop on heating, the non-mesophase portion of the pitch is readily soluble in organic solvents such as quinoline and pyridine, while the mesophase portion is essentially insoluble. [1] In the case of pitches which do not develop non-mesophase insolubles when heated, the insoluble content of the heat treated pitch over and above the insoluble content of the pitch before it has been heat treated corresponds essentially to the mesophase content. (2) In the case of pitches which do develop non-mesophase insolubles when heated, the insoluble content of the heat treated pitch over and above the insoluble content of the pitch before it has been heat treated is not solely due to the conversion of the pitch to mesophase, but also represents non-mesophase insolubles which are produced along with the mesophase during the heat treatment. Pitches which contain infusible non-mesophase insolubles (either present in the original pitch or developed by heating) in amounts sufficient to prevent the development of homogeneous bulk mesophase are unsuitable for use in the present invention, as noted above. Generally, pitches which contain in excess of about 2 percent by weight of such infusible materials are unsuitable. The presence or absence of such homogeneous bulk mesophase regions, as well as the presence or absence of infusible non-mesophase insolubles, can be visually observed by polarized light microscopy examination of the pitch (see, e.g., Brooks, J. D., and Taylor, G. H., "The Formation of Some Graphitizing Carbons," *Chemistry and Physics of Carbon*, Vol. 4, Marcel Dekker, Inc., New York, 1968, pp. 243–268; and Dubois, J., Agache, C., and White, J. L., "The Carbonaceous Mesophase Formed in the Pyrolysis of Graphitizable Organic Materials," Metallography 3, pp. 337–369, 1970). The amounts of each of the these materials may also be visally estimated in this manner.

Conventional molecular weight analysis techniques can be employed to determine the molecular weight characteristics of the mesophase pitches produced in accordance with the present invention. In order to permit molecular weight determinations to be conducted independently on both the mesophase and non-mesophase portions of the pitch, the two phases may be conveniently separated through the use of a suitable organic solvent. As noted above, except for certain non-mesophase insolubles present in the original pitch or which, in some instances, develop on heating, the non-mesophase portion of the pitch is readily soluble in organic solvents such as quinoline and pyridine, while the mesophase portion is essentially insoluble. [3] After separation of the two phases with a solvent in this manner, the non-mesophase portion of the pitch may be recovered from the solvent by vacuum distillation of the solvent.

(3) The non-mesophase portion of the pitch may be readily separated from the mesophase portion by extraction with quinoline at 75° C. or by Soxhlet extraction in boiling pyridine (115° C.).

One means which has been employed to determine the number average molecular weight of the mesophase pitches produced in accordance with the present invention involves the use of a vapor phase osmometer. The utilization of instruments of this type for molecular weight determinations has been described by A. P. Brady et al. (Brady, A. P., Huff, H., and McGain, J. W., J. Phys. & Coll. Chem. 55, 304, (1951). The osmometer measures the difference in electrical resistance between a sensitive reference thermistor in contact with a pure solvent, and a second thermistor in contact with a solution of said solvent having dissolved therein a known concentration of a meterial whose molecular weight is to be determined. The difference in electrical resistance between the two thermistors is caused by a different in temperature between the thermistors which is produced by the different vapor pressures of the solvent and the solution. By comparing this value with the differences in resistance obtained with said solvent and standard solutions of said solvent containing known concentrations of compounds of known molecular weights, it is possible to calculate the molecular weight of the solute material. A drop of pure solvennt and a drop of a solution of said solvent having dissolved therein a known concentration of the material whose molecular weight is being determined are suspended side by side on a reference thermistor and sample thermistor, respectively, contained in a closed thermostated chamber saturated with a solvent vapor, and the resistance of the two thermistors is measured and the difference between the two recorded. Since a solution of a given solvent will always have a lower vapor pressure than the pure solvent, a differential mass transfer occurs between the two drops and the solvent vapor phase, resulting in greater overall condensation on (and less evaporation from) the solution drop than on the solvent drop. This difference in mass transfer causes a temporary temperature difference between the two thermistors (due to differences in loss of heat of vaporization between the two drops) which is proportional to the difference in vapor pressure between the two drops. Since the difference in vapor pressure between the two drops, and hence the difference in temperature and resistance, (ΔR), between the two thermistors depends solely upon the number of molecules of the solute material dissolved in the solvent, and is independent of the chemical composition of the molecules, the mole fraction of solute in the solution, (N), can be determined from a plot of ΔR vs. N for such solvent and solutions of such solvent containing known concentrations of compounds of known molecular weight. (4) ΔR and N bear a direct linear relationship to each other, and from a determination of N it is possible to calculate the calibration constant, (K), for the solvent employed from the formula:

$$K = \Delta R/N$$

Having determined the value of K, the molecular weight of the material may be determined from the formula:

$$M_x = (K - \Delta R) \cdot (M_v \cdot W_x/\Delta R \cdot W_v)$$

wherein $M_x$ is the molecular weight of the material upon which the determination is being made, $K$ is the calibration constant for the solvent employed, $\Delta R$ is the difference in resistance between the two thermistors, $M_v$ is the molecular weight of the solvent, $W_v$ is the weight of the solvent, and $W_x$ is the weight of the material whose molecular weight is being determined. Of course, having once determined the value of the calibration constant of a given solvent, ($K$), the molecular weight of a given material may be determined directly from the formula.

(4) By the mole fraction of a given material in a solution, (N), is meant the number of moles of such material in the solution divided by the number of moles of such material in the solution plus the number of moles of the solvent.

While the molecular weight of the soluble portion of the pitch can be determined directly on a solution thereof, in order to determine the molecular weight of the insoluble portion, it is necessary that it first be solubilized e.g., by chemcial reduction of the auromatic bonds of such material with hydrogen. A suitable means for solubilizing coals and carbons by reduction of the aromatic bonds of these materials has been described by J. D. Brooks et al. (Brooks, J. D., and Silberman H., "The Chemical Reduction of Some Cokes and Chars", Fuel 41, pp. 67–69, 1962). This method involves the use of hydrogen generated by the reaction of lithium with ethylenediamine, and has been found to effectively reduce the aromatic bonds of carbonaceous materials without rupturing carbon-carbon bonds. Such method has been suitably employed to solubilize the insoluble portion of the pitches prepared in accordance with the invention.

Another means which has been employed to determine the molecular weight characteristics of the mesophase pitches produced in accordance with the present invention is gel permeation chromatography (GPC). This technique has been described by L. R. Snyder, L. R., "Determination of Asphalt Molecular Weight Distributions by Gel Permeation Chromatography," Anal. Chem. 41, pp. 1223–1227, 1969). A gel permeation chromatograph is employed to fractionate a solution of polymer or polymer related molecules of various sizes, and the molecular weight distribution of the sample is determined with the aid of a detection system which is linearly responsive to solute concentration, such as a differential refractometer or a differential ultraviolet absorption spectrometer. As in the case of the vapor phase osmometry technique, in order to permit molecular weight determinations to be conducted independently on both the mesophase and non-mesophase portions of the pitch, the two phases must first be separated through the use of a suitable organic solvent. Again, while the molecular weight of the soluble portion of the pitch can be determined directly on a solution thereof, in order to determine the molecular weight of the insoluble portion, it is necessary that it first be solubilized.

Fractionation of the sample whose molecular weight distribution is being determined is effected by dissolving the sample in a suitable solvent and passing the solution through the chromatograph and collecting measured fractions of the solution which elute through the separation column of the chromatograph. A given volume of solvent is required to pass molecules of a given molecular size through the chromatograph, so that each fraction of solution which elutes from the chromatograph contains molecules of a given molecular size. The fractions which flow through the column first contain the higher molecular weight molecules, while the fractions which take the longest time to elute through the column contain the lower molecular weight molecules.

After the sample has been fractionated, the concentration of solute in each fraction is determined by means of a suitable detection system, such as a differential refractometer or a differential ultraviolet absorption spectrometer. When a differential refractometer is employed, the refractive index of each fraction is automatically compared to that of the pure solvent by means of two photoelectric cells which are sensitive to the intensity of light passing through such fractions and solvent, and the differences in signals intensities between the two cells are automatically plotted against the cumulative elution volume of the solution. Since the magnitude of these differences in signal intensity is linearly related to the concentration by weight of solute molecules present, the relative concentration by weight of molecules in each fraction can be determined by dividing the differential signal intensity for that fraction by the total integrated differential signal intensity of all the fractions. This relative concentration may be graphically depicted by a plot of the differential signal intensity for each fraction against the cumulative elution volume of the sample.

The molecular weight of the molecules of each fraction can then be determined by standard techniques, e.g., by the osmometry techniques described above. Since most conventional pitches are composed of similar types of molecular weights of the various fractions of a particular sample have been determined, that sample may be used as a standard and the molecular weights of the fractions of subsequent samples can be determined from the known molecular weights of like fractions of the standard. Thus, molecular weight determinations need not be repeatedly made on each fraction of each sample, but may be obtained from the molecular weights determined for like fractions of the standard. For convenience, a molecular weight distribution curve depicting the relationship of the molecular weight to the elution volume of the standard may be prepared by plotting the molecular weights determined for the standard fractions against the cumulative elution volume of the standard. The molecular weights of the molecules of the various chromatographic fractions of any given sample can then be directly read froam this curve. As aforementioned, the relative concentration by weight of solute molecules in each fraction can be determined by differential refractive index measurements.

To facilitate the molecular weight determinations, the differential signal intensities and elution volume values obtained on a given sample, together with previously determined molecular weight data relating to the various chromatographic fractions of a standard pitch, can be processed by a computer and transcribed into a complete molecular weight distribution analysis. By this procedure, complete printouts are routinely provided of number average molecular weight ($M_n$), weight average molecular weight ($M_w$), molecular weight distribution parameter ($M_2/M_N$), as well as a compilation of molecular weight and percentage by weight of solute present in each chromatographic fraction of a sample.

Aromatic base carbonaceous pitches having a carbon content of from about 92 percent by weight to about 96 percent by weight and a hydrogen content of from about 4 percent by weight to about 8 percent by weight are generally suitable for producing mesophase pitches which can be employed to produce fibers capable of being heat treated to produce fibers having a high Young's modulus elasticity and a high tensile strength. Elements other than carbon and hydrogen, such as oxygen, sulfur and nitrogen, are undesirable and should not be present in excess of about 4 percent by weight. The presence of more than such amount of extraneous elements may disrupt the formation of carbon crystallites during subsequent heat treatment and prevent the development of a graphitic-like structure within the fibers produced from these materials. In addition, the presence of extraneous elements reduces the carbon content of the pitch and hence the ultimate yield of carbon fiber. When such extraneous elements are present in amounts of from about 0.5 percent by weight to about 4 percent by weight, the pitches generally have a carbon content of from about 92–95 percent by weight, the balance being hydrogen.

Petroleum pitch, coal tar pitch and acenaphthylene pitch, which are well-graphitizing pitches, are preferred starting materials for producing the mesophase pitches which are employed to produce the fibers of the instant invention. Petroleum pitch, of course, is the residuum carbonaceous material obtained from the distillation of crude oils or the catalytic cracking of petroleum distillates. Coal tar pitch is similarly obtained by the distillation of coal. Both of these materials are commercially available natural pitches in which mesophase can easily be produced, and are preferred for this reason. Acenaphthylene pitch, on the other hand, is a synthetic pitch which is preferred because of its ability to produce excellent fibers. Acenaphythylene pitch can be produced by the pyrolysis of polymers of acenaphthylene as described by Edstrom et al. in U.S. Pat. No. 3,574,653.

Some pitches, such a fluoranthene pitch, polymerize very rapidly when heated and fail to develop large coalesced domains of mesophase, and are, therefore, not suitable precursor materials. Likewise, pitches having a high infusible non-insoluble content in organic solvents such as quinoline or pyridine, or those which develop a high infusible non-mesophase insoluble content when heated, should not be employed as starting materials, as explained above, because these pitches are incapable of developing the homogeneous bulk mesophase necessary to produce highly oriented carbonaceous fibers capable of being converted by heat treatment into carbon fibers having a high Young's modulus of elasticity and high tensile strength. For this reason, pitches having an infusible quinoline-insoluble or pyridine-insoluble content of more than about 2 percent by weight (determined as described above) should not be employed, or should be filtered to remove this material before being heated to produce mesophase phase. Preferably, such pitches are filtered when they contain more than about 1 percent by weight of such infusible, insoluble material. Most petroleum pitches and synthetic pitches have a low infusible, insoluble content and can be used directly without such filtration. Most coal tar pitches, on the other hand, have a high infusible, insoluble content and require filtration before they can be employed.

As the pitch is heated at a temperature between 350° and 500° C. to produce mesophase, the pitch will, of course, pyrolyze to a certain extent and the composition of the pitch will be altered, depending upon the temperature, the heating time, and the composition and structure of the starting material. Generally, however, after heating a carbonaceous pitch for a time sufficient to produce a mesophase content of from about 40 percent by weight to about 90 percent by weight, the resulting pitch will contain a carbon content of from about 94–96 percent by weight and a hydrogen content of from about 4–6 percent by weight. When such pitches contain elements other than carbon and hydrogen in amounts of from about 0.5 percent by weight to about 4 percent by weight, the mesophase pitch will generally have a carbon content of from about 92–95 percent by weight, the balance being hydrogen.

After the desired mesophase pitch has been prepared, it is spun into fibers by conventional techniques, e.g., by melt spinning, centrifugal spinning, blow spinning, or in any other known manner. As noted above, in order to obtain highly oriented carbonaceous fibers capable of being heat treated to produce carbon carbon fibers having a high Young's modulus of elasticity and high tensile strength, the pitch must, under quiescent conditions, form a homogeneous bulk mesophase having large coalesced domains, and be nonthixotropic under the conditions employed in the spinning. Further, in order to obtain uniform fibers from such pitch, the pitch should be agitated immediately prior to spinning so as to effectively intermix the immiscible mesophase and non-mesophase portions of the pitch.

The temperature at which the pitch is spun depends of course, upon the temperature at which the pitch exhibits a suitable viscosity. Since the softening temperature of the pitch, and its viscosity at a given temperature, increases as the mesophase content of the pitch increases, the mesophase content should not be permitted to rise to a point which raises the softening point of the pitch to excessive levels. For this reason, pitches having a mesophase content of more than about 90 percent are generally not employed. Pitches containing a mesophase content of about 40 percent by weight usually have a viscosity of about 200 poises at about 300° C. and about 10 poises at about 375° C., while pitches containing a mesophase content of about 90 percent by weight exhibit similar viscosities at temperatures above 430° C. Within this viscosity range, fibers may be conveniently spun from such pitches at a rate of from about 50 feet per minute to about 1000 feet per minute and even up to about 3000 feet per minute. Preferably, the pitch employed has a mesophase content of from about 50 percent by weight to about 65 percent by weight and exhibits a viscosity of from about 30 poises to about 150 poises at temperatures of from about 340° to about 380° C. At such viscosity and temperature, uniform fibers having diameters of from about 5 microns to about 25 microns can be easily spun. As previously mentioned, however, in order to obtain the desired fibers, it is important that the pitch be nonthixotropic and exhibit Newtonian or plastic flow behavior during the spinning of the fibers.

The carbonaceous fibers produced in this manner are highly oriented graphitizable materials having a high degree of preferred orientation of their molecules parallel to the fiber axis. By "graphitizable" is meant that these fibers are capable of being converted thermally (usually by heating to a temperature in excess of about 2500° C., e.g., from about 2500° to about 3000° C.) to a structure having the three-dimensional order characteristic of polycrystalline graphite.

The fibers produced in this manner, of course, have the same chemical composition as the pitch from which they were drawn, and like such pitch contain from about 40 percent by weight to about 90 percent by weight mesophase. When examined under magnification by polarized light microscopy techniques, the fibers exhibit textural variations which give them the appearance of a "mini-composite." Large elongated anisotropic domains, having a fibrillarshaped appearance, can be seen distributed throughout the fiber. These anisotropic domains are highly oriented and preferentially aligned parallel to the fiber axis. It is believed that these anisotropic domains, which are elongated by the shear forces exerted on the pitch during spinning of the fibers, are not composed entirely of mesophase, but are also made up of non-mesophase. Evidently, the non-mesophase is oriented, as well as drawn into elongated domains, during spinning by these shear forces and the orienting effects exerted by the mesophase domains as they are elongated. Isotropic regions may also be present, although they may not be visible and are difficult to differentiate from those anisotropic regions which happen to show extinction. Characteristically, the oriented elongated domains have diameters in excess of 5000 A, generally from about 10,000 A to about 40,000 A, and because of their large size are easily observed when examined by conventional polarized light microscopy techniques at a magnification of 1000. (The maximum resolving power of a standard polarized light microscope having a magnification factor of 1000 is only a few tenths of a micron [1 micron = 10,000 A] and anisotropic domains having dimensions of 1000 A or less cannot be detected by this technique.)

While fibers spun from a pitch containing in excess of about 85 percent by weight mesophase often retain their shape when carbonized without any prior thermosetting, fibers spun from a pitch containing less than about 85 percent by weight mesophase require some thermosetting before they can be carbonized. Thermosetting of the fibers is readily effected by heating the fibers in an oxygen-containing atmosphere for a time sufficient to render them infusible. The oxygen-containing atmosphere employed may be pure oxygen or an oxygen-rich atmosphere. Most conveniently, air is employed as the oxidizing atmosphere.

The time required to effect thermosetting of the fibers will, of course, vary with such factors as the particular oxidizing atmosphere, the temperature employed, the diameter of the fibers, the particular pitch from which the fibers are prepared, and the mesophase content of such pitch. Generally, however, thermosetting of the fibers can be effected in relatively short periods of time, usually in from about 5 minutes to about 60 minutes.

The temperature employed to effect thermosetting of the fibers must, of course, not exceed the temperature at which the fibers will soften or distort. The maximum temperature which can be employed will thus depend upon the particular pitch from which the fibers were spun, and the mesophase content of such pitch. The higher the mesophase content of the pitch, the higher will be its softening temperature, and the higher the temperature which can be employed to effect thermosetting of the fibers. At higher temperatures, of course, fibers of a given diameter can be thermoset in less time than is possible at lower temperatures. Fibers prepared from a pitch having a lower mesophase content, on the other hand, require relatively longer heat treatment at somewhat lower temperatures to render them infusible.

A minimum temperature of at least 250° C. is generally necessary to effectively thermoset the carbinaceous fibers produced in accordance with the invention. Temperatures in excess of 400° C. may cause melting and/or excessive burn-off of the fibers and should be avoided. Preferably, temperatures of from about 275° to about 350° C. are employed. At such temperatures, thermosetting can generally be effected within from about 5 minutes to about 60 minutes. Since it is undesirable to oxidize the fibers more than necessary to render them totally infusible, the fibers are generally not heated for longer than about 60 minutes, or at temperatures in excess of 400° C.

After the fibers have been thermoset, the infusible fibers are carbonized by heating in an inert atmosphere, such as that described above, to a temperature sufficiently elevated to remove hydrogen and other volatiles and produce a substantially all-carbon fiber. Fibers having a carbon content greater than about 98 percent by weight can generally be produced by heating to a temperature in excess of about 1000° C., and at temperatures in excess of about 1500° C., the fibers are completely carbonized.

Usually, carbonization is effected at a temperature of from about 1000° to about 2000° C., preferably from about 1500° to about 1900° C. Generally, residence times of from about 0.5 minute to about 25 minutes, preferably from about 1 minute to about 5 minutes, are employed. While more extended heating times can be employed with good results, such residence times are uneconomical and, as a practical matter, there is no advantage in employing such long periods.

In order to ensure that the rate of weight loss of the fibers does not become so excessive as to disrupt the fiber structure, it is preferred to heat the fibers for a brief period at a temperature of from about 700° to about 900° C. before they are heated to their final carbonization temperature. Residence times at these temperatures of from about 30 seconds to about 5 minutes are usually sufficient. Preferably, the fibers are heated at a temperature of about 700° for about one-half minute and then at a temperature of about 900° C. for like time. In any event, the heating rate must be controlled so that the volatilization does not proceed at an excessive rate.

In a preferred method of treatment, continuous filaments of the fibers are passed through a series of heating zones which are held at successively higher temperatures. If desired, the first of such zones may contain an oxidizing atmosphere where thermosetting of the fibers is effected. Several arrangements of apparatus can be utilized in providing the series of heating zones. Thus, one furnace can be used with the fibers being passed through the furnace several times and with the temperature being increased each time. Alternatively, the fibers may be given a single pass through several furnaces, with each successive furnace being maintained at a higher temperature than that of the previous furnace. Also, a single furnace with several heating zones maintained at successively higher temperatures in the direction of travel of the fibers, can be used.

The carbon fibers produced in this manner have a highly oriented structure characterized by the presence of carbon crystallites preferentially aligned parallel to the fiber axis, and are graphitizable materials which when heated to graphitizing temperatures develop the three-dimensional order characteristic of polycrystalline graphite and graphitic-like properties associated therewith, such as high density and low electrical resistivity.

If desired, the carbonized fibers may be further heated in an inert atmosphere, as described hereinbefore, to a still higher temperature in a range of from about 2500° to about 3300° C., preferably from about 2800° to about 3000° C., to produce fibers having not only a high degree of preferred orientation of their carbon crystallites parallel to the fiber axis, but also a structure characteristic of polycrystalline graphite. A residence time of about 1 minute is satisfactory, although both shorter and longer times may be employed, e.g., from about 10 seconds to about 5 minutes, or longer. Residence times longer than 5 minutes are uneconomical and unnecessary, but may be employed if desired.

The fibers produced by heating at a temperature about about 2500°, preferably above about 2800° C., are characterized as having the three-dimensional order of polycrystalline graphite. This three-dimensional order is established by the X-ray diffraction pattern of the fibers, specifically by the presence of the (112) cross-lattice line and the resolution of the (10) band into two distinct lines, (100) and (101). The short arcs which constitute the (00*l*) bands of the pattern show the carbon crystallites of the fibers to be preferentially aligned parallel to the fiber axis. Microdensitometer scanning of the (002) band of the exposed X-ray film indicate this preferred orientation to be no more than about 10°, usually from about 5° to about 10° (expressed as the full width at half maximum of the azimuthal intensity distribution). Apparent layer size ($L_a$) and apparent stack height ($L_c$) of the crystallites are in excess of 1000 A and are thus too large to be measured by X-ray techniques. The interlayer spacing (d) of the crystallites, calculated from the distance between the corresponding (00*l*) diffraction arcs, is no more than 3.37 A, usually from 3.36 A to 3.37 A.

EXAMPLE

The following example is set forth for purposes of illustration so that those skilled in the art may better understand the invention. It should be understood that it is exemplary only, and should not be construed as limiting the invention in any manner.

EXAMPLE 1

A commercial petroleum pitch was employed to produce a pitch having a mesophase content of about 57 percent by weight. The precursor pitch had a number average molecular weight of 400, a density of 1.23 grams/cc., a softening temperature of 120° C. and contained 0.83 percent by weight quinoline insolubles (Q.I. was determined by quinoline extraction at 75° C.). Chemical analysis showed a carbon content of 93.0%, a hydrogen content of 5.6%, a sulfur content of 1.1% and 0.044% ash.

The mesophase pitch was produced by heating the precursor petroleum pitch to a temperature of 415° C. at a rate of about 5° C. per hour, and maintaining the pitch at this temperature for an additional 5 hours under a nitrogen atmosphere.

In order to illustrate that conversion to mesophase proceeds more rapidly under vacuum, a mesophase pitch was prepared from the same precursor pitch and in the same manner except that the pitch was heated under a pressure of less than 1 millimeter Hg. The resulting pitch had a pyridine insoluble content of 71 percent compared to a pyridine insoluble content of only 57 percent for the pitch prepared in the absence of a vacuum.

What is claimed is:

1. A process for producing a mesophase pitch which comprises heating a carbonaceous pitch at a temperature of from 350° to 450° C. for a time sufficient to produce a mesophase content of from 40 percent by weight to 90 percent by weight while subjecting the pitch to a pressure of less than 100 millimeters Hg during formation of the mesophase.

2. A process as in claim 1 wherein the pitch is heated at a temperature of from 380° to 440° C. for a time sufficient to produce a mesophase content of from 50 percent by weight to 65 percent by weight.

3. A process as in claim 1 wherein the pitch is subjected to a pressure of less than 30 millimeters Hg.

* * * * *